US005909862A

United States Patent [19]

Ratliff et al.

[11] Patent Number: 5,909,862

[45] Date of Patent: Jun. 8, 1999

[54] COMBINED IRON, IRON HOLDER AND IRONING BOARD

[76] Inventors: Sharon L. Ratliff, 7425 Walnut Ave., Fair Oaks, Calif. 95628; James W. Johnson, 616 Vernon Oaks Dr., Roseville, Calif. 95678

[21] Appl. No.: 08/901,866

[22] Filed: Jul. 29, 1997

[51] Int. Cl.[6] ..... D06F 79/02

[52] U.S. Cl. ..... 248/117.4; 248/117.3; 248/117.6; 248/551

[58] Field of Search ..... 248/551, 117.1, 248/117.2, 117.3, 117.4, 117.5, 117.6, 117.7

[56] References Cited

U.S. PATENT DOCUMENTS

| | | | |
|---|---|---|---|
| D. 211,124 | 5/1968 | Echols . | |
| D. 211,603 | 7/1968 | Wilson . | |
| 958,634 | 5/1910 | Griffeth | 248/117.5 |
| 1,881,144 | 10/1932 | Stein | 248/117.4 |
| 2,514,400 | 7/1950 | Larkins . | |
| 2,528,846 | 11/1950 | Sitnick et al. . | |
| 2,529,132 | 11/1950 | Burnish, III et al. | 248/117.1 |
| 2,657,000 | 10/1953 | Tonks | 248/117.6 |
| 3,062,492 | 11/1962 | Hedger | 248/117.1 |
| 3,136,516 | 6/1964 | Wentz . | |
| 3,176,947 | 4/1965 | Inverso . | |
| 3,426,990 | 2/1969 | Pady | 248/117.6 |
| 3,477,672 | 11/1969 | Agrusa . | |
| 3,729,778 | 5/1973 | McGrath | 248/117.4 X |
| 3,951,369 | 4/1976 | Kocsak . | |
| 3,967,802 | 7/1976 | Lomagno . | |
| 5,108,056 | 4/1992 | McBounds | 248/117.4 |
| 5,316,249 | 5/1994 | Anderson | 248/146 |
| 5,671,097 | 9/1997 | Merriweather, Jr. | 248/551 X |

*Primary Examiner*—Derek J. Berger
*Attorney, Agent, or Firm*—Lothrop & West

[57] ABSTRACT

An ironing system for guests of the hospitality industry that is not only compact in size, for storage in a guest room closet, but is also convenient and safe to use when the guest needs to press garments or other articles of wearing apparel. By combining the customary iron and the usual ironing board with a specially constructed iron holder and tethering arrangement, property damage and loss is contained, all to the benefit of management and guest alike.

7 Claims, 4 Drawing Sheets

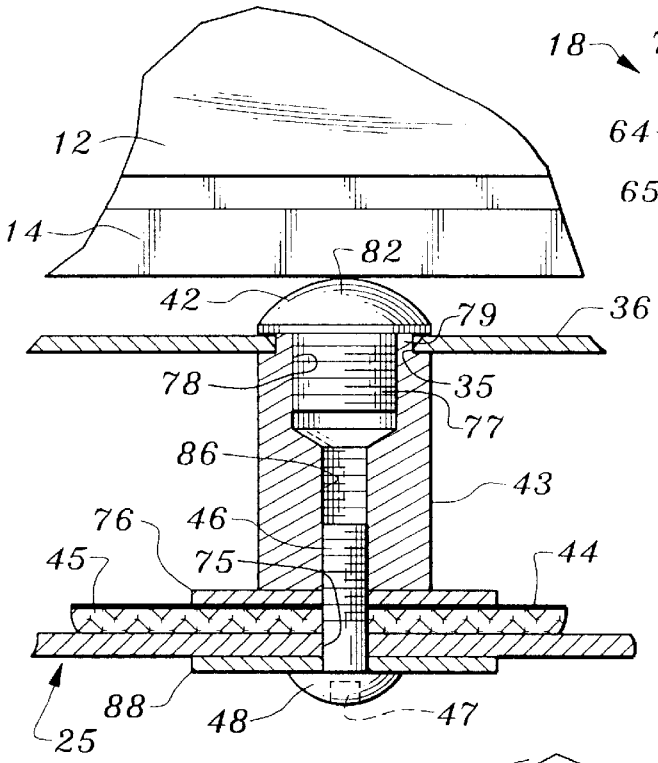
Fig. 6
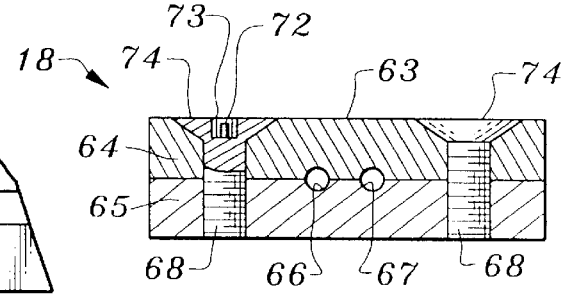
Fig. 8
Fig. 7
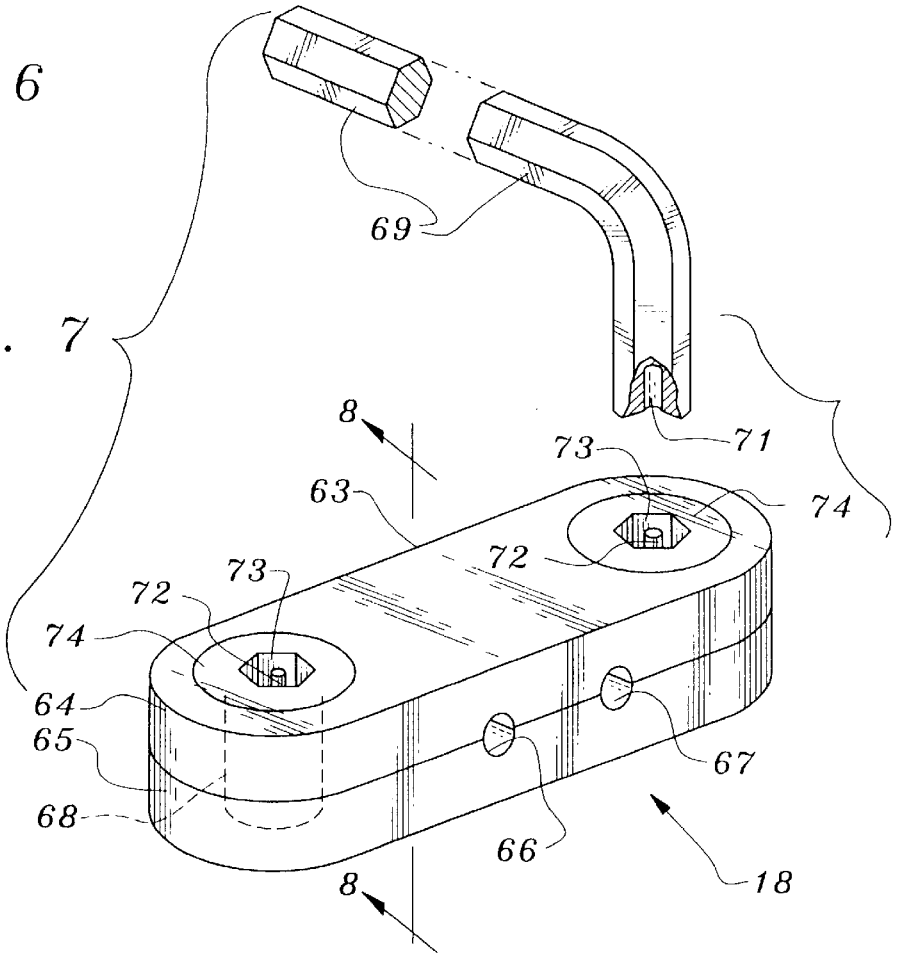

COMBINED IRON, IRON HOLDER AND IRONING BOARD

BACKGROUND OF THE INVENTION

1. Field of the Invention

The invention relates generally to improvements in ironing systems provided by the hospitality industry to guests.

2. Prior Art

Most of the better hotels, motels, inns, resorts and other members of the hospitality industry provide guests with irons and ironing boards to enable the guests to press garments. Usually, the ironing board is located in a guest room closet supported by a bracket mounted on the closet wall. Nearby, the iron is stored, usually in vertical attitude, in some form of housing affixed to the closet wall.

In order to press wearing apparel, it is merely necessary to lift the ironing board from the bracket, carry it to a location in the room that is close to a wall outlet, unfold the board to a convenient height and plug in the iron brought from the housing.

While this amenity is a welcome addition to any accommodation, risk to the guest and damage to the property is an ever present possibility in the typical prior art installation just described. More specifically, guests are sometimes prone to remove the iron from the closet and, instead of using the ironing board provided, will connect the iron to an electrical outlet and press their garments on the bed spread, bed sheet, or on the carpet or on a towel placed on a desk, dresser or other handy article of furniture. Not only does this practice often result in scorching the spread, sheet, carpet, towel, or furniture, but it sometimes causes fires when the guest leaves the room and forgets to disconnect the iron.

Furthermore, it is not unknown for a guest to check out with the iron concealed in the guest's luggage.

Although not of paramount consideration in the overall operation, scorch damage to the property and theft of the iron itself are of on-going concern to management. These problems are unfortunately inherent in the ironing systems heretofore used.

Nine U.S. patents were made of record in a co-pending design patent application, Ser. No. 29/061,365, filed by applicants herein on Oct. 11, 1996, for the Iron Holder, one of the key components of the present invention.

The nine cited patents are identified as follows:

Echols Des. 211,124

Wilson et al. Des. 211,603

Larkins Des. 2,514,400

Sitnick et al. Des. 2,528,846

Wentz Des. 3,136,516

Inverso Des. 3,176,947

Agrusa Des. 3,477,672

Kocsak Des. 3,951,369

Lomagno Des. 3,967,802

It is believed that the present invention is neither anticipated by nor rendered obvious by the art cited above, copies of which accompany the Information Disclosure Statement.

SUMMARY OF THE INVENTION

The combined iron, iron holder and ironing board, as arranged pursuant to the present invention, provide an integrated structure which overcomes the objections to and shortcomings of the prior art.

The iron and the iron holder as well as the iron holder and the ironing board are joined together in the preferred embodiment. The iron cannot be used to press garments unless the ironing board and the iron holder are also present.

A safety/security tether resiliently connects the iron to the iron holder and the iron holder in turn, is attached to the ironing board. The fastenings are installed with custom wrenches not ordinarily carried by a guest. Theft and tampering are inhibited.

The iron holder serves as a safe repository for the iron, whether hot or cold, and whether stored or in use; and the iron holder is especially constructed so as to dissipate any heat transferred from a plurality of unique support buttons which, themselves, are fabricated from materials having very high heat tolerance and very low thermal conductivity.

Guest convenience and safety are enhanced while management benefits from theft containment and reduced property damage and liability.

BRIEF DESCRIPTION OF THE DRAWING FIGURES

The drawing figures illustrate the best mode presently contemplated of carrying out the invention.

FIG. 1 is a front elevation of the combined unit in folded condition and suspended in vertical attitude from a hanger bracket on a closet wall;

FIG. 2 elevation thereof,

FIG. 7 is a perspective view to an enlarged scale, of the tamper-proof clamp-type fitting securing the tether cord to the iron, and showing a custom hex key wrench for use with the fitting; and, FIG. 8 is a sectional view of the fitting, taken on the line 8—8 in FIG. 7. Introductory Portion

DETAILED DESCRIPTION OF THE PREFERRED EMBODIMENT

Figure 1:
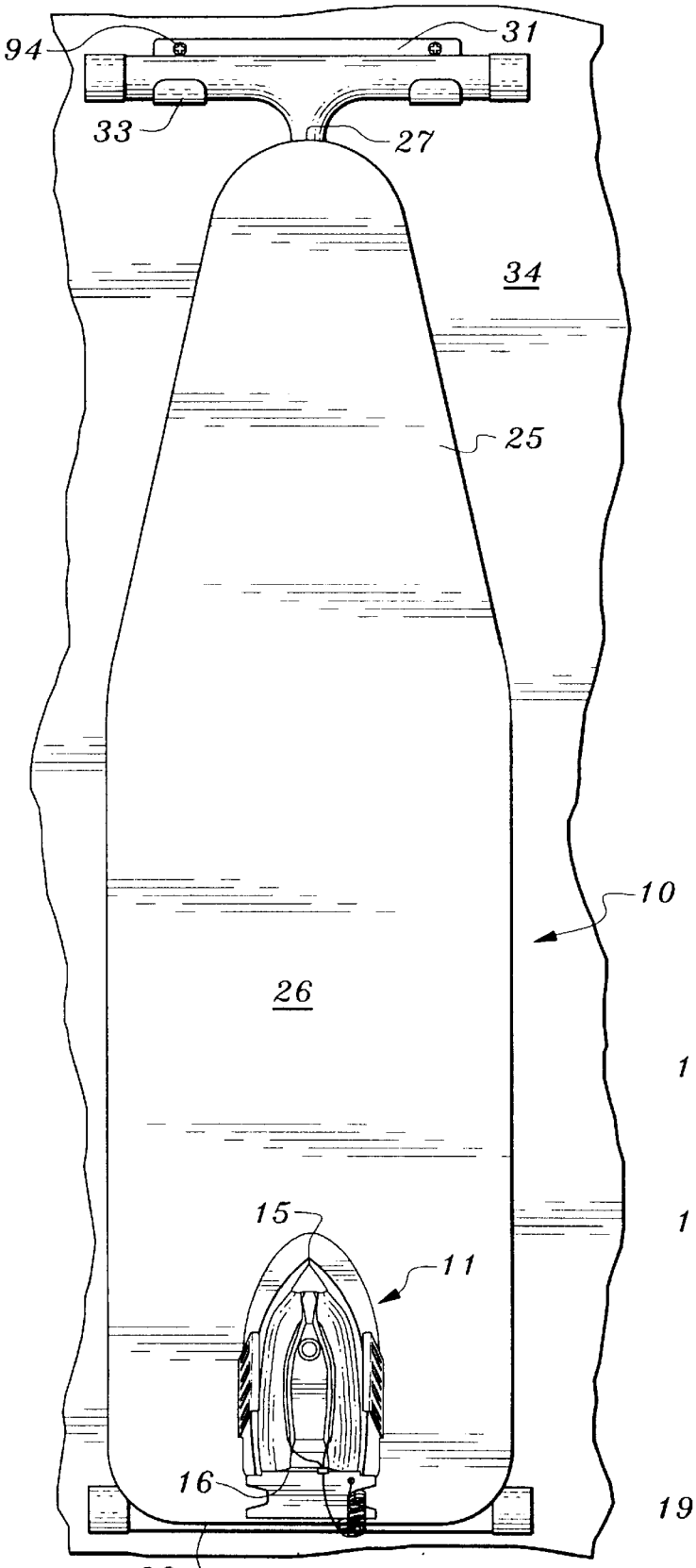
Figure 2:
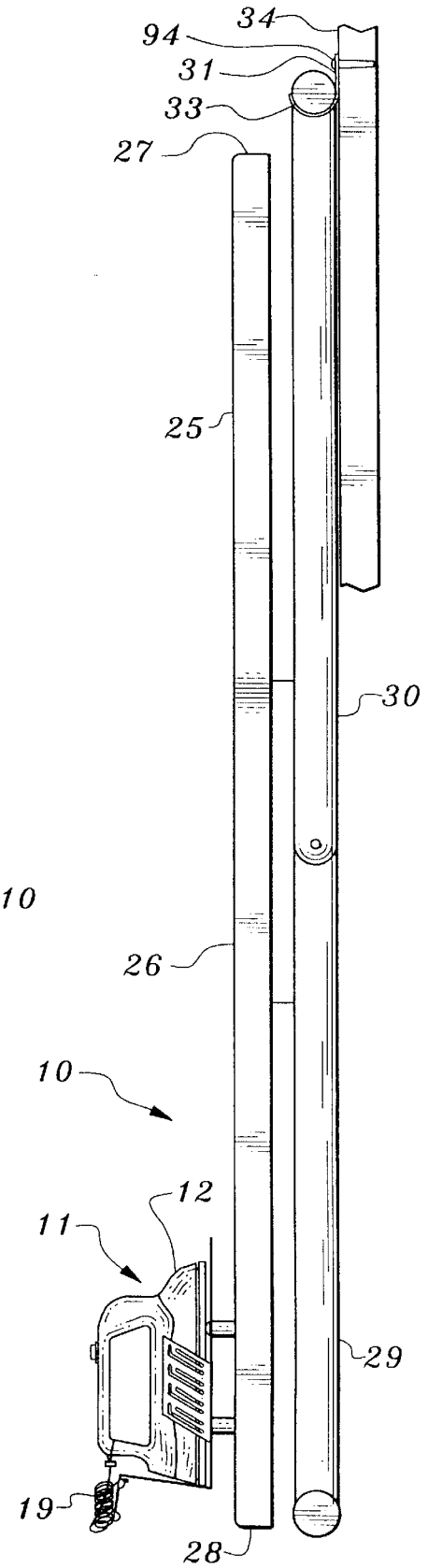
Figure 3:
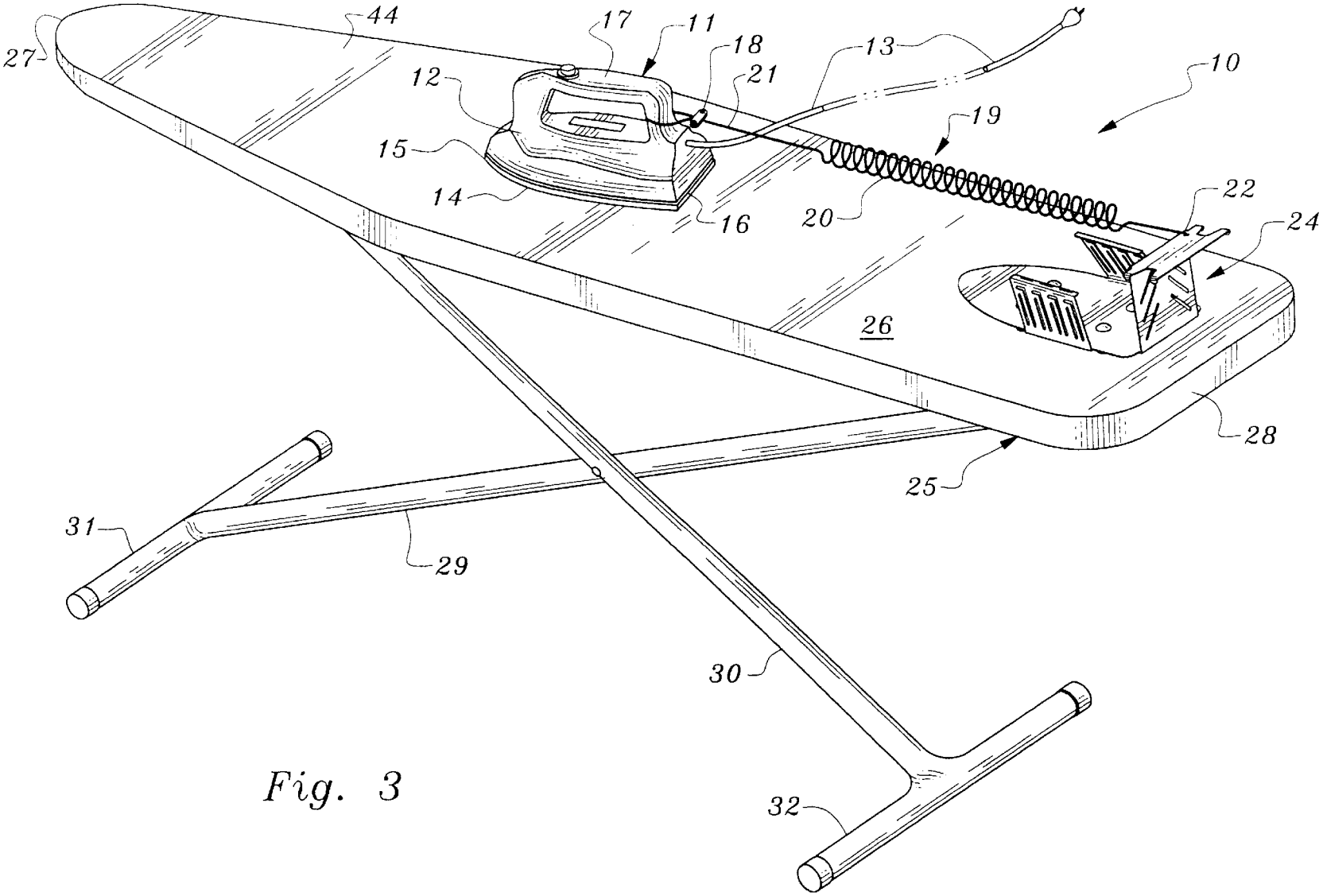
FIG. 3 is a top, rear perspective view of the combined unit in unfolded condition, with a cold iron removed from the holder and positioned face down on the upper surface of the board, and with electrical conductor disconnected from an outlet.

As most clearly appears in FIGS. 1, 2, and 3, the Combined Iron, Iron Holder, and Ironing Board of the invention is designated by the reference numeral 10.

The iron 11 is preferably of a conventional make and includes the customary body 12 and electrical conductor 13. The lower portion of the body 12 includes a sole plate 14, or foot plate, extending from a pointed toe end 15 to a blunt heel end 16.

A continuous loop handle 17 mounted on the body 12 serves the usual purpose of manipulating the iron; and, in the preferred embodiment also serves as a component of anti-theft tethering means 19. The tethering means 19 comprises an extensible coiled cord 20 secured at one end 21 to the handle 17 by a special tamper proof clamp-type fitting 18 and at the other end 22 to an anchor 23 (see FIG. 4) on an iron holder 24 mounted on an ironing board 25.

The ironing board 25 is also of conventional make, and, affords certain functions in addition to the ordinary one of providing an exposed planar surface 26, usually covered by a pad and some type of heat resistant fabric. The ironing board 25 extends from a first, tapered end 27 to a second, butt end 28. The customary pivoted legs 29 and 30, and respective transverse feet 31 and 32 on the bottoms of the legs 29 and 30, are arranged in a manner which enables the user either to fold the legs into the compact condition of the board illustrated in FIGS. 1 and 2 or to unfold and releasably lock the legs 29 and 30 so that the board 25 is horizontally disposed at a height convenient for the user, as illustrated in FIG. 3.

When in folded condition the ironing board 25 is conveniently stored in a closet with the tapered end 27 up and with the respective transverse foot 31 suspended by a mounting bracket 33 affixed to the closet wall 34 (see FIGS. 1 and 2). In the vertical folded attitude assumed by the board, the amount of closet space required by the board is negligible.

The key link in the combination is the iron holder 24 which is connected both to the iron 11 and the ironing board 25.

Figure 4:
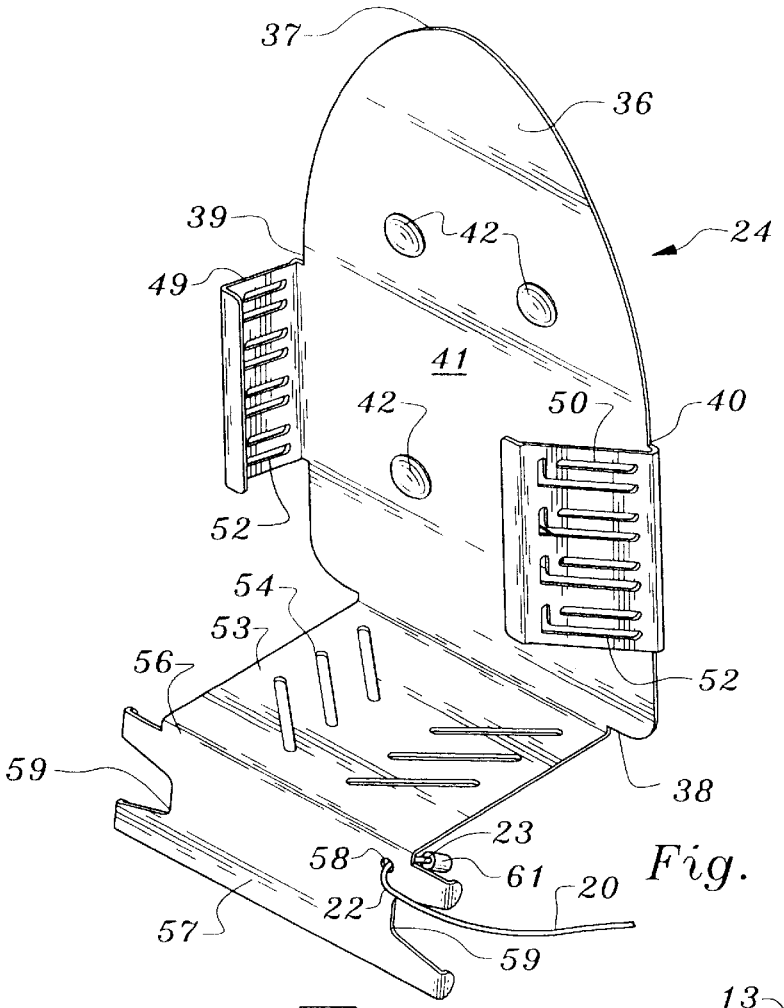
FIG. 4 is a perspective view of the iron holder, per se, to an enlarged scale.

The iron holder 24, as most clearly appears in FIG. 4, comprises a base plate 36 having generally the same shape as, although slightly larger in size than, the sole plate 14 of the iron 11. Thus, the base plate 36 extends from a moderately pointed toe end 37 to a blunt heel end 38 and between opposite side edges 39 and 40.

Covering a plurality of holes 35 in the upper surface 41 of the base plate 36 is a plurality of raised buttons 42 (see FIGS. 4 and 6) of a special phenolic material capable of withstanding the high temperature of the iron sole plate 14, but of very low thermal conductivity so as to minimize the extent of heat transfer to the base plate 36. Axially aligned with the holes 35 is a plurality of stanchions 43 supporting the base plate 36 in spaced relation above the heat resistant cover 44 and pad 45 covering the ironing board 25.

The stanchions 43 are mounted on the board 25 by threaded fasteners 46, or screws, driven by an Allen, or hex key, wrench engageable with the walls of hexagonal recesses 47 in the heads 48 of the stanchion screws 46. Since the hexagonal wrenches suitable for installing the fasteners must be of a precise size, the likelihood of theft is decreased.

Upstanding from portions of the side edges 39 and 40 of the base plate are opposed side walls 49 and 50, or wings, arranged in mirror symmetry. The side walls 49 and 50 are inclined somewhat inwardly and, adjacent their upper edges, are curved inwardly toward each other in order to embrace the opposite sides 51 of the iron 11. Since irons of different make differ somewhat in size and shape, the material from which the iron holder 24 is fabricated is chosen to afford a degree of malleability enabling the wings 49 and 50 to be bent inwardly or outwardly in order to embrace the sides 51 of the iron in snug relation. The material is stiff enough, however, to hold the iron firmly in place. A suitable material is 18 gauge steel which, for aesthetics is powder coated in white or ivory color, the powder coating affording resistance to discoloration from heat.

The wings 49 and 50, furthermore, are generously provided with vents, in the form of openings 52, enhancing the dissipation of heat received from the sides 51 of the iron 11.

When the iron 11 is positioned in the iron holder 24, the blunt, or heel end 16, of the iron is abutted by an end wall 53 upstanding from the blunt end 38 of the base plate 36 of the iron holder. As in the wings 49 and 50, vent openings 54 assist in dissipating heat from the heel end of a hot iron 11 lodged in the iron holder 24.

The nether end portion of the end wall 53 is bent along a bend line 56 to afford a ledge 57 having an opening 58 formed therein to receive the end 22 of the tether cord 20 and thus serve as part of the tether cord anchor 23 on the iron holder 24. The anchor 23 is substantially tamper proof owing to the provision of a compressible metal collar 61 clamped on the end 22 of the tether cord 20. The collar 61 is larger than the opening 58 and thus secures the tether cord.

A pair of opposed recesses 59 in the opposite ends of the ledge 57 provide convenient areas in which to wrap the conductor 13 of the iron 11 when the iron is stored.

Figure 5:
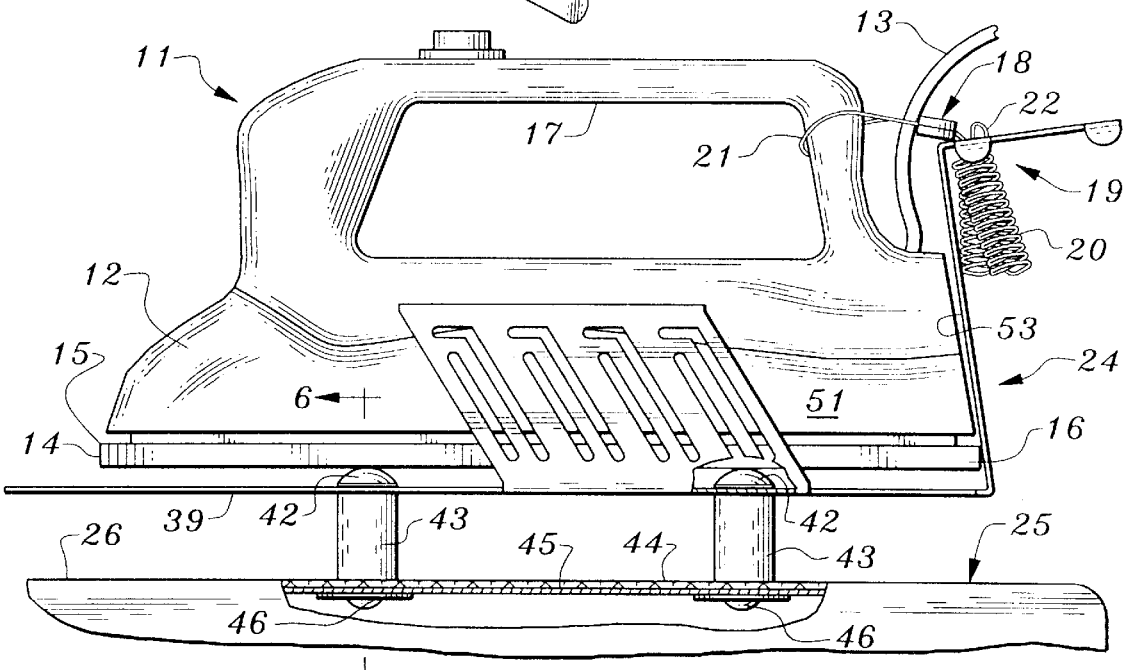
FIG. 5 is a side elevation, to an enlarged scale, of the iron connected to and immobilized in the iron holder and the iron holder secured to the ironing board, with portions of the components being shown in the section; and, FIG. 6 is a sectional view, to an enlarged scale, taken on the line indicated by the numerals 6—6 in FIG. 5.

The iron 11 is secured to the cord 20 by threading the end 21 of the tether cord 20 through the loop-type handle 17 on the iron and recurving the cord end 21 back on itself, as appears most clearly in FIG. 5, for clamping in the special fitting 18.

The special, tamper-proof clamp-type fitting 18 (see FIGS. 7 and 8) is installed on the parallel portions of the tether cord 20 by clamping together the two halves 64 and 65 of a block 63 with the two cord portions interposed in half tracks 66 and 67 formed in the respective halves 64 and 65. Special machine screws 68 are then tightened by a custom, modified Allen wrench 69 so as to clamp together the two halves 64 and 65 of the fitting 63.

As can be seen most clearly in FIG. 7, the wrench 69 essentially comprises a hollow hex key wrench, with a central axial opening 71 deep enough to receive an axial pin 72 disposed within the axial, hexagonal recess 73 in the head 74 of the machine screws 68. Once the especially modified screws 68 are driven into clamping position, even the customary "Allen-head" wrench will not be able to unscrew, and thereby release, the tether cord from the fitting 18.

Thus, the iron 11 is secured to the iron holder 24 in a substantially tamper-proof manner.

Similar comments apply to the structure serving to mount the iron holder 24 to the ironing board 25.

With particular reference to the enlarged sectional view, FIG. 6, the procedure for mounting the iron holder 24 on the ironing board 25 (and accompanying pad and cover) preferably includes the use of a template (not shown) in order to establish the location of the four stanchions 43 on the large, or butt end of the ironing board 25. The template carries indicia corresponding to the holes 35 in the base plate 36. The template indicia holes 35, are centered on the longitudinal centerline of the ironing board 25 with the two end holes 35 (i.e. the two holes 35 adjacent the end wall 53) about three to four inches from the broad end of the board 25.

Once the position of the four holes is established on the ironing board cover 44, four small pilot holes are gently pierced through the cover 44 and the pad 45. These small pilot holes will often align with the perforated holes found in many sheet metal ironing boards and will usually align with the openings in any wire mesh top board. If the four holes do not align with any openings or with openings of proper diameter in the board top, the necessary openings 75 in the board top can be drilled in the board.

Once the four openings 75 in the ironing board, cover and pad are in place, one top washer 76 is placed axially in register with each of the openings 75, the top washers 76 being located on the top surface of the heat resistant, fabric cover 44.

The iron holder 24, (with the threaded necks 77 of the four buttons 42 inserted through their respective holes 35 in the base plate 36 and threadably engaged with tapped registering sockets 78 in the stanchions 43) is thereupon positioned so that each of the stanchions 43 is axially aligned with and supported on the respective top washer 76.

It is to be noted that the top portion of each of the necks 77 of the buttons 42 is encompassed by a ring 79 integrally formed on top of the stanchion. It is often convenient to pre-assemble the button-stanchion fittings on the iron holder. In this case, the upstanding ring 79 on the top of the stanchion 43 is inserted through the hole 35 so that the top of the ring 79 is flush with the top surface of the base plate 36 and abuts the shoulder on the bottom of the mushroom-shaped button cap 82. It is preferable that there be an interference fit between the ring 79 and the hole 35 requiring swaging and thereby giving rigidity to the pre-assembly.

In axial alignment with the threaded socket 78 is a drilled and tapped opening 86 in the stanchion. Thus, when the base plate 36, with the four pre-fitted buttons 42 and stanchions 43, is placed in register with the top washers 76, four bottom washers 88 are properly positioned and the respective stanchion screws 46 are inserted from below and hand-tightened in the tapped openings 86.

When all four hand-tightened screws 46 are in place in the threaded openings 86 in the stanchions, a hex key wrench is inserted in each of the hexagonal recesses 47 in the heads 48 of the screws 46 and driven to assure a tight fit of all components, including the base plate 36 of the iron holder 24 and the ironing board 25, as well as the buttons 42 and the stanchions 43.

The ironing board 25 and the tightly secured iron holder can then be rested on the ironing board hanger, or mounting, bracket 33 which is attached to the wall with a pair of drywall anchor screws 94 of conventional type, as appears in FIG. 2.

We claim:

1. In combination with an electric iron having a sole plate extending from a pointed toe end to a blunt heel end and an ironing board having an ironing surface extending from a first, tapered end to a second, butt end, a. an iron holder comprising:

(i ) a base plate similar in shape and size to the sole plate of the iron and extending from a pointed front end to a blunt rear end; and, (ii) a plurality of heat-resistant buttons mounted on said base plate to support the sole plate of the iron when the iron is positioned in said holder;

b. means for mounting said iron holder on the ironing board with said base plate spaced from the adjacent surface of the ironing board, said mounting means including a plurality of stanchions interposed between the bottom of said base plate and the adjacent surface of said board, and anti-theft means for securing said stanchions to the board;

c. means for tethering the iron to said iron holder; and, d. means associated with said iron holder for immobilizing the iron when the sole plate of the iron is supported on said buttons and the board is moved between an unfolded position in which the ironing surface is horizontal and a folded position in which the ironing surface is vertical.

2. A combination as in claim 1 in which said iron immobilizing means includes a pair of lateral side walls upstanding from a portion of the lateral edges of said base plate to embrace a portion of the lateral sides of the iron; and an end wall upstanding from said blunt rear end of said base plate for abutting engagement with the blunt heel end of the iron.

3. A combination as in claim 2 in which said lateral side walls and said end wall of said iron holder are formed of heat conducting material and are provided with a plurality of heat dissipating openings.

4. A combination as in claim 3 in which said lateral side walls are formed of bendable material enabling said side walls to be deformed to embrace the sides of the interposed iron in snug relation.

5. A combination as in claim 4 in which said end wall is formed of bendable material enabling said end wall to be deformed to the angle of the blunt heel end of the iron positioned in said iron holder.

6. A combination as in claim 2 in which said tethering means includes an extensible cord secured at one end to the iron and at the other end to said iron holder.

7. A combination as in claim 1 in which said anti-theft means comprises a plurality of screws each including a threaded portion and a head portion, said head portion being formed with an axial hexagonal recess adapted to receive the operative end of a hex key wrench, said threaded portions of said screws being wrench-driven through the board from below and into respective tapped openings in said stanchions.

* * * * *